US007455059B2

(12) United States Patent
Shaffer

(10) Patent No.: US 7,455,059 B2
(45) Date of Patent: Nov. 25, 2008

(54) VIBRATION DAMPENING ARROW RETENTION SPRING

(76) Inventor: Michael Jay Shaffer, 144 Joel Dr., Mogadore, OH (US) 44260

( * ) Notice: Subject to any disclaimer, the term of this patent is extended or adjusted under 35 U.S.C. 154(b) by 234 days.

(21) Appl. No.: 11/024,577

(22) Filed: Dec. 29, 2004

(65) Prior Publication Data

US 2006/0137670 A1 Jun. 29, 2006

(51) Int. Cl.
*F41B 5/12* (2006.01)

(52) U.S. Cl. ..... 124/25

(58) Field of Classification Search ..... 124/25, 124/89; 16/86 R, 86 A; 292/342, 343
See application file for complete search history.

(56) References Cited

U.S. PATENT DOCUMENTS 466,104 A * 12/1891 Naegele ..... 292/343
654,562 A * 7/1900 Bowler ..... 292/342
941,885 A * 11/1909 LaBaw ..... 292/343
2,198,303 A * 4/1940 Chu ..... 16/86 A
3,788,299 A * 1/1974 Mathews ..... 124/35.1
4,722,318 A * 2/1988 Yankey ..... 124/25
5,553,596 A 9/1996 Bednar
5,598,829 A 2/1997 Bednar
5,649,520 A 7/1997 Bednar
6,085,736 A 7/2000 Osterhues
6,758,205 B2 * 7/2004 Kronfeld ..... 124/89

* cited by examiner

*Primary Examiner*—John Ricci
(74) *Attorney, Agent, or Firm*—Brous McDowell; John M. Skeriotis

(57) ABSTRACT

A crossbow includes a body having a stock member and a barrel connected to the stock member. The barrel has an arrow receiving area for receiving an arrow. The crossbow also includes a bow having a pair of bow arms, a bowstring connected to the bow arms, a bowstring release mechanism used to hold and release the bowstring and, a scope mount used to hold a scope. An arrow retention spring is provided for retaining the arrow to the arrow receiving area. A vibration dampener may be positioned between the arrow retention spring and the scope mount in order to dampen the arrow retention spring vibrations made when shooting the crossbow. This greatly reduces unwanted noise.

22 Claims, 3 Drawing Sheets

VIBRATION DAMPENING ARROW RETENTION SPRING

BACKGROUND OF THE INVENTION

A. Field of Invention

This invention relates generally to the field of crossbows and, more specifically, to apparatuses and methods used to dampen the vibrations of a crossbow's arrow retention spring.

B. Description of the Related Art

Crossbows in general have been used for many years as a weapon for hunting, fishing, and for target shooting. Significant development of the crossbow has occurred to increase the force with which an arrow is shot, increase shooting accuracy, and to make the crossbow safe. In general, the crossbow includes a body including a stock member and a barrel connected to the stock member. The barrel has an arrow receiving area for receiving the arrow that is to be shot. The crossbow also includes a bow connected to the body and having a pair of bow arms, a bowstring connected to the bow arms, and a bowstring release mechanism used to hold and release the bowstring in order to propel the arrow. Generally an arrow retention spring is provided and used for retaining the arrow to the arrow receiving area prior to activation of the bowstring release mechanism.

One problem with the large forces provided with crossbows is the corresponding large vibrations. These vibrations result in unwanted noise that is both too loud (as measured in decibels) and too long in duration. One cause of unwanted crossbow vibrations is the arrow retention spring. Arrow retention springs are known to cause an unwanted "ping" sound when the arrow is released from the crossbow. This application provides a new and very effective invention to reduce arrow retention spring vibrations and the corresponding unwanted noise. In this way the disadvantages known in the art can be overcome in a way that is better, more efficient and that provides better overall results.

SUMMARY OF THE INVENTION

According to one aspect of this invention, a crossbow includes a body having a stock member and a barrel operatively connected to the stock member. The barrel has an arrow receiving area. A bow is operatively connected to the body and includes a pair of bow arms. A bowstring is operatively connected to the bow arms and a bowstring release mechanism is operatively connected to the body for selectively holding and releasing the bowstring. An arrow retention spring is used to retain an arrow to the arrow receiving area. The arrow retention spring has a first end operatively connected to a crossbow device and a second end adapted to contact the arrow. Vibration dampening means is provided to dampen vibrations caused by the arrow retention spring. In a preferred embodiment, the vibration dampening means comprises a vibration dampener positioned between the arrow retention spring and a crossbow member.

According to another aspect of this invention, to dampen the vibrations in a crossbow caused by an arrow retention spring, a vibration dampener is inserted between the arrow retention spring and a crossbow member. In one embodiment, the vibration dampener is adhered to the arrow retention spring. In another embodiment, the vibration dampener is adhered to the crossbow member. In a preferred embodiment, the crossbow member is a scope mount having a channel and the vibration dampener is slid, narrow end first, between the arrow retention spring and the scope mount within the channel.

One advantage of this invention is that vibrations, including the resulting unwanted noise, caused by an arrow retention spring can be virtually eliminated.

Another advantage of this invention is that unwanted arrow retention spring vibrations can be easily reduced by simply inserting a vibration dampener between the arrow retention spring and the scope mount.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
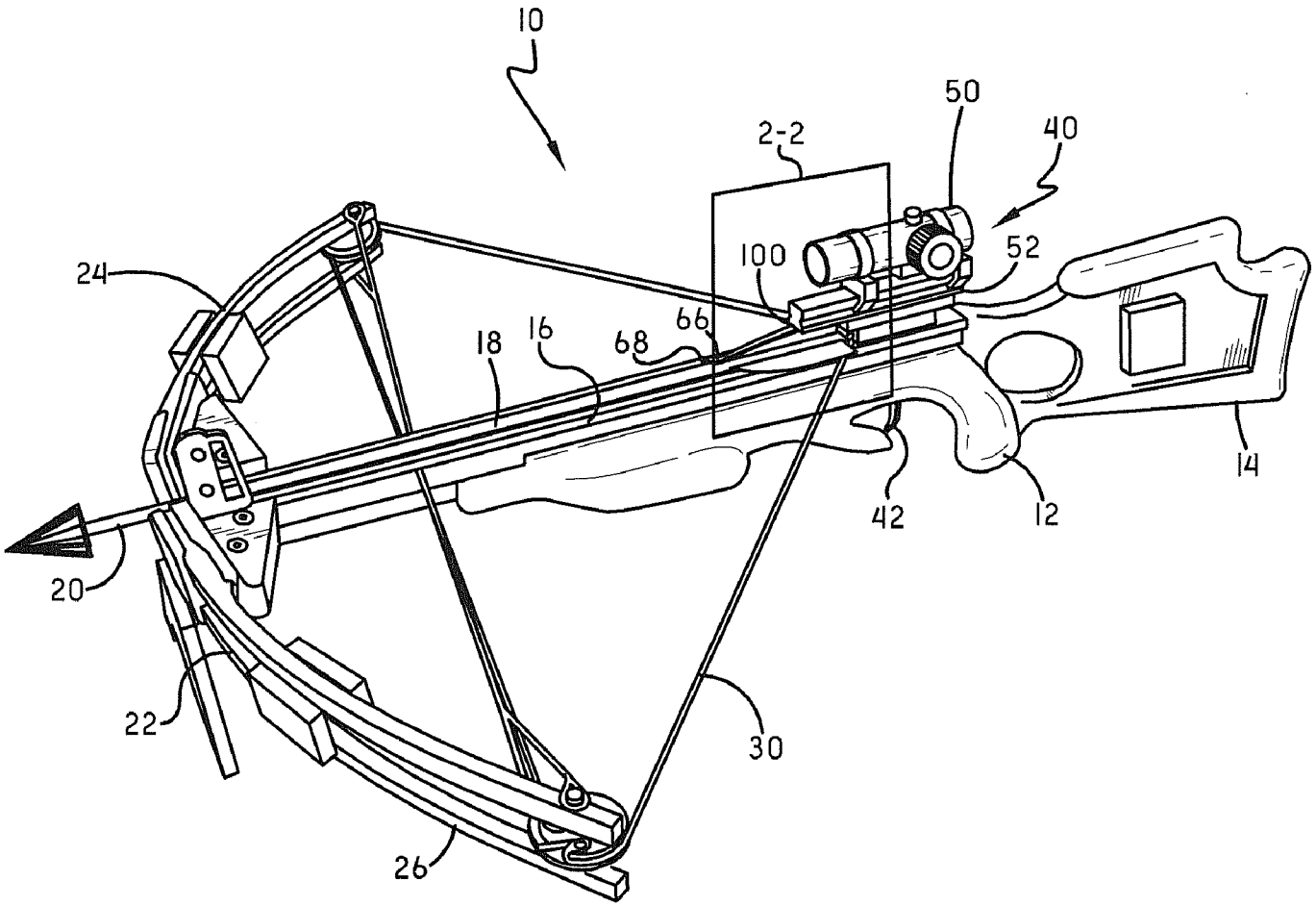
FIG. 1 is a perspective view of a crossbow equipped with the vibration dampener of this invention.

Referring now to the drawings wherein the showings are for purposes of illustrating a preferred embodiment of the invention only and not for purposes of limiting the same, FIG. 1 shows a crossbow 10 equipped with the vibration dampening means 100 of this invention. The crossbow has a body 12 including a stock member 14 and a barrel 16 that is operatively connected by any conventional manner to the stock member 14. The barrel 16 has an arrow receiving area 18, which may be a groove formed in the top of the barrel 16 as shown, that receives an arrow 20. The crossbow 10 also has a bow 22 operatively connected to the body 12 that includes a pair of bow arms 24, 26. A bowstring 30 is connected to the bow arms 24, 26 in any manner chosen with sound engineering judgment.

With continuing reference to FIG. 1, a bowstring release mechanism 40 may be connected to the body 12 and is used to selectively hold and release the bowstring 30. The bowstring release mechanism 40 shown includes a trigger mechanism 42 but it should be understood that this invention works well with any type of release mechanism. A scope 50 may be selectively connected to a scope mount 52 that is connected to the bowstring release mechanism 40, as shown. The particular manner in which the scope 50 is connected to the scope mount 52 and in which the scope mount 52 is connected to the bowstring release mechanism 40 can be any manner chosen with sound engineering judgment. The preferred scope mount 52 has a channel 54, seen best in FIG. 2, on the bottom that will be discussed further below. The operation of the crossbow 10, including the bow 22, the bowstring release mechanism 40 and scope 50 is well known and thus will not be describe in detail.

Figure 2:
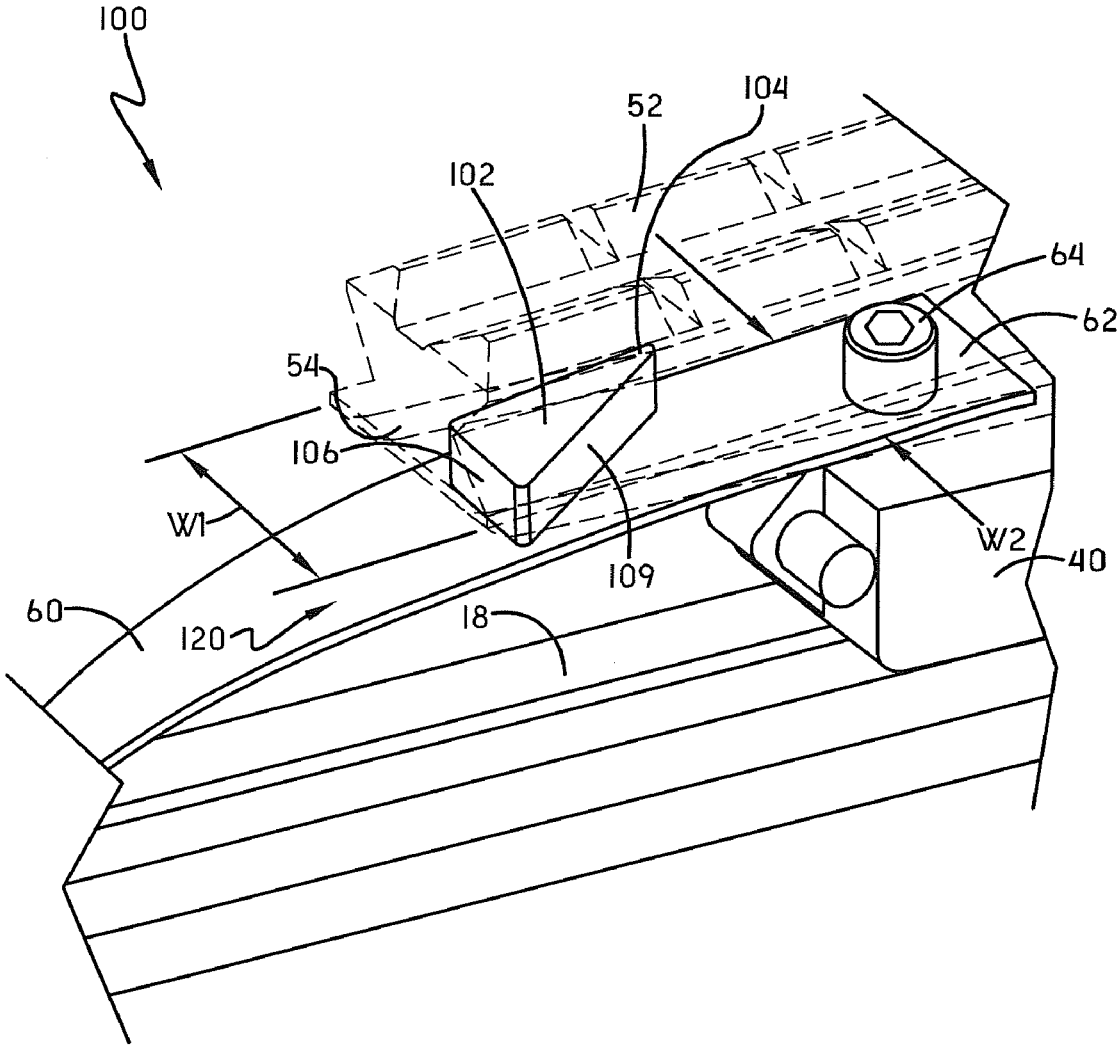
FIG. 2 is a perspective close-up view of portion 2-2 from FIG. 1, with the scope, arrow, and bowstring removed, showing the vibration dampener positioned on the arrow retention spring.
Figure 3:
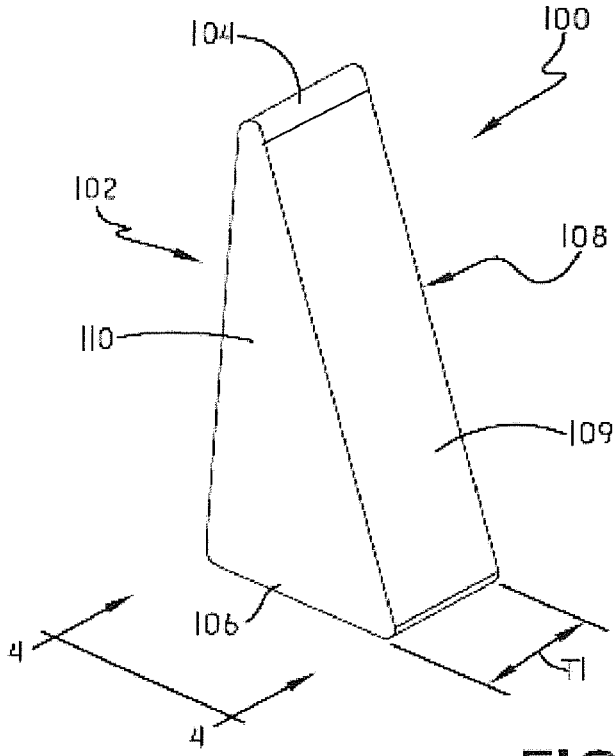
FIG. 3 is a perspective view of the vibration dampener.

With reference now to FIGS. 1 and 2, an arrow retention spring 60 is provided and is used to retain or hold the arrow 20 to the arrow receiving area 18 of the barrel 16. The arrow retention spring 60 has a first end 62 that, in the preferred embodiment, is attached to the bowstring release mechanism 40 with a bolt 64, as seen best in FIG. 2. The arrow retention spring 60 also has a second end 66, preferably curved as shown in FIG. 1, which contacts the arrow 20 to maintain the arrow 20 within the arrow receiving area 18. In order to fully maintain the alignment of the arrow retention spring 60 relative to the arrow 20, it is also preferred that the first end 62 of the arrow retention spring 60 be received within the channel 54 formed in the bottom of the scope mount 52. Thus, it is preferred that the width W1 of the channel be only slightly larger than the width W2 of the first end 62 of the arrow retention spring 60. The arrow retention spring 60 may be formed of any material and may have any length, width and thickness that provide a sufficient biasing force against the arrow 20. However, in the preferred embodiment the width of the arrow retention spring 60 tapers down from a maximum width W2 at the first end 62 to a width at the second end 66 that is slightly larger than the width of the arrow receiving area 18. Most preferably the second end 66 is coated with a material 68, such as plastic or rubber, which minimizes friction between the arrow retention spring 60 and the arrow 20.

Figure 4:
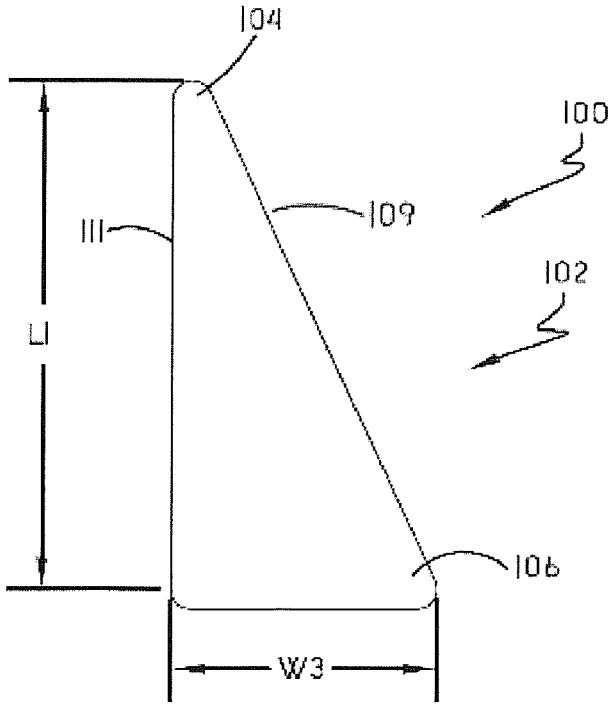
FIG. 4 is a side view of the vibration dampener taken along section 4-4 of FIG. 3.

With reference now to FIGS. 1-4, the vibration dampening means 100 is provided to dampen the vibrations caused by the arrow retention spring 60. The vibration dampening means 100 greatly reduces the unwanted noise produced by the arrow retention spring 60 when the arrow 20 is shot from the crossbow 10. While the vibration dampening means 100 can be accomplished with any devise chosen with sound engineering judgment, in the preferred embodiment the vibration dampening means 100 is provided by a vibration dampener 102 as shown. The preferred vibration dampener 102 is wedge shaped having a generally triangular shape as observed from a side view, as shown in FIG. 4. The wedge shape provides a variable and progressive rate of dampening depending on the pressure applied between the scope mount 52 and the arrow retention spring 60. The triangular shape is preferably a right triangle, as shown. However, this invention would also work well if the triangular shape was an isosceles triangle shape, an equilateral triangle shape, or any other generally triangular shape.

With continuing reference to FIGS. 1-4, the vibration dampener 102 has a length L1, a narrow end 104 (preferably radiused, as shown), a wide end 106 opposite the narrow end 104 and having a width W3, and a thickness T1. These dimensions can generally be any chosen with sound engineering judgment. Preferably, the width W3 is less than the width W1 of the channel so that the vibration dampener 102 can be received within the scope mount channel 54. It is also preferred that the width W3 of the vibration dampener 102 be at least as wide as the width of the arrow retention spring 60, over the area the wide end 106 contacts, to maximize the dampening effect. The preferred vibration dampener 102 has four sides, 108, 109, 110, 111, as shown. Any pair of opposing sides may be used as contact surfaces. In fact, the four sides in combination with the wedge shape maximize the dampening options available. In one embodiment, opposing sides 108 and 110 contact the scope mount 52 and the arrow retention spring 60. This provides a first dampening characteristic because the vibration dampener 102 may have a constant thickness T1 along its length L1. In another embodiment, opposing sides 109 and 111 contact the scope mount 52 and the arrow retention spring 60. This provides a second dampening characteristic because the vibration dampener 102 may have a varied dimension (from nearly zero at the narrow end 104 to a width W3 at wide end 106) along its length L1. It should also be noted that in a preferred embodiment, shown, the surfaces of the scope mount 52 and the arrow retention spring 60 may not be parallel. In this case, the use of opposing sides 108 and 110 to contact the scope mount 52 and the arrow retention spring 60 is preferred to increase the dampening effect as the scope mount 52 and the arrow retention spring 60 surfaces move closer together during the normal loading and firing of the crossbow 10.

Still referring to FIGS. 1-4, the vibration dampener 102 is preferably formed of a highly pliable compound, more preferably formed of a flexible polyurethane, and most preferably formed of a material known as VibaSORB™ made by Vibracheck of R&R Enterprises, Inc., Pensacola, Fla. The vibration dampener 102 material permits limited movement of the arrow retention spring 60 but critically dampens the oscillations to significantly reduce vibrations and resulting noise. The vibration dampener 102 can be of any color but is preferably a non-earth tone, such as light blue, soft grey, or orange, to contrast with the earth tone colored environment that a hunter typically hunts in. This makes it easy for the user to see the vibration dampener 102 and insert it as will be discussed below.

With continuing reference to FIGS. 1-4, a preferred method of attaching the vibration dampener 102 to the crossbow 10 will now be described. Most simply, the vibration dampener 102 is inserted between the arrow retention spring 60 and the scope mount 52 as shown. Though not required for operation, an attaching means 120 (see FIG. 2) may be used to attach one or more sides, 108, 109, 110, 111 of the vibration dampener 102 to the arrow retention spring 60 and/or the scope mount 52. In the preferred embodiment, the attaching means 120 is an adhesive coated to any side or sides of the vibration dampener 102 that are to contact the arrow retention spring 60 and/or the scope mount 52. However, the attaching means 120 can be any means chosen with sound engineering judgment including tape and threaded fasteners. It is preferred to slide the vibration dampener 102 into position narrow end 104 first, as shown, to make insertion very easy for the user. It is also preferred, as noted above, to slide the vibration dampener 102 within the channel 54 in the scope mount 52. This helps to ensure that the vibration dampener 102 will remain in place between the arrow retention spring 60 and the scope mount 52.

With reference now to FIGS. 1 and 2, it should be noted that the vibration dampener 102 of this invention could be used in a similar way but with different crossbow components. For example, in the preferred embodiment described above, the first end 62 of the arrow retention spring 60 is connected to the bowstring release mechanism 40. This is not a requirement. The first end 62 of the arrow retention spring 60 could be connected to any crossbow device chosen with sound engineering judgment as long as the arrow retention spring 60 can provide sufficient biasing means to the arrow 20. Similarly, in the preferred embodiment described above, the vibration dampener 102 is inserted between the arrow retention spring 60 and the scope mount 52. This is not a requirement. The vibration dampener 102 could be positioned between the arrow retention spring 60 and any crossbow member chosen with sound engineering judgment as long as the crossbow member can withstand the limited pressure exerted upon it by the vibration dampener 102. Thus, the preferred crossbow device is the bowstring release mechanism 40 and the preferred crossbow member is the scope mount 52.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

1. A crossbow comprising:

a body comprising a stock member and a barrel operatively connected to the stock member, the barrel having an arrow receiving area;

a bow operatively connected to the body and having a pair of bow arms;

a bowstring operatively connected to the bow arms;

a bowstring release mechanism operatively connected to the body for selectively holding and releasing the bowstring;

an arrow retention spring for retaining an arrow to the arrow receiving area, the arrow retention spring having a first end operatively connected to a crossbow device and a second end adapted to contact the associated arrow; and, a vibration dampening means for dampening vibrations caused by the arrow retention spring, wherein the vibration dampening means comprises a vibration dampener positioned between the arrow retention spring and a crossbow member, and, wherein the vibration dampener is attached to the arrow retention spring with an adhesive.

2. A crossbow comprising:

a body comprising a stock member and a barrel operatively connected to the stock member, the barrel having an arrow receiving area;

a bow operatively connected to the body and having a pair of bow arms;

a bowstring operatively connected to the bow arms;

a bowstring release mechanism operatively connected to the body for selectively holding and releasing the bowstring;

an arrow retention spring for retaining an arrow to the arrow receiving area, the arrow retention spring having a first end operatively connected to a crossbow device and a second end adapted to contact the associated arrow; and, a vibration dampening means for dampening vibrations caused by the arrow retention spring, wherein the vibration dampening means comprises a vibration dampener positioned between the arrow retention spring and a crossbow member;

wherein the vibration dampener is wedge shaped; and wherein the crossbow device is the bowstring release mechanism and the crossbow member is a scope mount positioned on the bowstring release mechanism.

3. The crossbow of claim 2 wherein the scope mount has a channel that receives the first end of the arrow retention spring and the vibration dampener.

4. A method of dampening vibrations in a crossbow caused by an arrow retention spring, comprising the steps of:

providing a crossbow comprising: (a) a body comprising a stock member and a barrel operatively connected to the stock member, the barrel having an arrow receiving area; (b) a bow operatively connected to the body and having a pair of bow arms; (c) a bowstring operatively connected to the bow arms; (d) a bowstring release mechanism operatively connected to the body for selectively holding and releasing the bowstring; (e) a crossbow member; and, (f) an arrow retention spring for retaining an arrow to the arrow receiving area, the arrow retention spring having a first end operatively connected to a crossbow device and a second end adapted to contact the associated arrow;

inserting a vibration dampener between the arrow retention spring and the crossbow member; and, adhering the vibration dampener to the arrow retention spring.

5. A method of dampening vibrations in a crossbow caused by an arrow retention spring, comprising the steps of:

providing a crossbow comprising: (a) a body comprising a stock member and a barrel operatively connected to the stock member, the barrel having an arrow receiving area; (b) a bow operatively connected to the body and having a pair of bow arms; (c) a bowstring operatively connected to the bow arms; (d) a bowstring release mechanism operatively connected to the body for selectively holding and releasing the bowstring; (e) a crossbow member; and, (f) an arrow retention spring for retaining an arrow to the arrow receiving area, the arrow retention spring having a first end operatively connected to a crossbow device and a second end adapted to contact the associated arrow;

inserting a vibration dampener that is wedged shaped and has a narrow end between the arrow retention spring and the crossbow member; by sliding the vibration dampener narrow end first between the arrow retention spring and the crossbow member.

6. The method of claim 5 wherein the crossbow member is a scope mount, the step of sliding the vibration dampener narrow end first between the arrow retention spring and the crossbow member, comprises the step of:

sliding the vibration dampener narrow end first between the arrow retention spring and the scope mount.

7. The method of claim 6 wherein the scope mount has a channel, the step of sliding the vibration dampener narrow end first between the arrow retention spring and the scope mount, comprises the step of:

sliding the vibration dampener within the channel in the scope mount.

8. A crossbow comprising:

a body having an arrow receiving area;

a bow operatively connected to the body and having a pair of bow arms;

a bowstring operatively connected to the bow arms;

a bowstring release mechanism operatively connected to the body for selectively holding and releasing the bowstring;

an arrow retention spring for retaining an arrow to the arrow receiving area; and, a vibration dampener for dampening vibrations caused by the arrow retention spring, wherein the vibration dampener is positioned between the arrow retention spring and a crossbow member having a channel;

wherein at least a portion of the first end of the arrow retention spring is received within the channel; and, wherein at least a portion of the vibration dampener is received within the channel.

9. A crossbow comprising:

a body having an arrow receiving area;

a bow operatively connected to the body and having a pair of bow arms;

a bowstring operatively connected to the bow arms;

a bowstring release mechanism operatively connected to the body for selectively holding and releasing the bowstring;

an arrow retention spring for retaining an arrow to the arrow receiving area; and, a vibration dampener for dampening vibrations caused by the arrow retention spring wherein the vibration dampener is positioned between the arrow retention spring and a crossbow member; and, wherein the vibration dampener comprises: two pair of opposing sides that may define contact surfaces contacting the arrow retention spring and the crossbow member respectively, the first pair of opposing sides providing the vibration dampener with a first dampening characteristic and the second pair of opposing sides providing the vibration dampener with a second dampening characteristic.

10. A crossbow comprising:

a body having an arrow receiving area;

a bow operatively connected to the body and having a pair of bow arms;

a bowstring operatively connected to the bow arms;

a bowstring release mechanism operatively connected to the body for selectively holding and releasing the bowstring;

an arrow retention spring for retaining an arrow to the arrow receiving area;

a vibration dampener for dampening vibrations caused by the arrow retention spring; and, wherein the vibration dampener is attached to the arrow retention spring with an adhesive.

11. A crossbow comprising:

a body comprising a stock member and a barrel operatively connected to the stock member, the barrel having an arrow receiving area;

a bow operatively connected to the body and having a pair of bow arms;

a bowstring operatively connected to the bow arms;

a bowstring release mechanism operatively connected to the body for selectively holding and releasing the bowstring;

an arrow retention spring for retaining an arrow to the arrow receiving area, the arrow retention spring having a first end operatively connected to the bowstring release mechanism and a second end adapted to contact the associated arrow; and, a vibration dampener for dampening vibrations caused by the arrow retention spring, the vibration dampener positioned between the arrow retention spring and a scope mount positioned on the bowstring release mechanism.

12. The crossbow of claim 11 wherein:

the scope mount has a bottom surface with a channel;

at least a portion of the first end of the arrow retention spring is received within the channel; and, at least a portion of the vibration dampener is received within the channel.

13. The crossbow of claim 11 wherein the vibration dampener comprises:

two pair of opposing sides that may define contact surfaces contacting the arrow retention spring and the scope mount respectively, the first pair of opposing sides providing the vibration dampener with a first dampening characteristic and the second pair of opposing sides providing the vibration dampener with a second dampening characteristic.

14. The crossbow of claim 13 wherein:

the vibration dampener has a substantially constant thickness along its length when the first pair of opposing sides define the contact surfaces; and, the vibration dampener has a varied thickness along its length when the second pair of opposing sides define the contact surfaces.

15. The crossbow of claim 11 wherein the vibration dampener is substantially colored with a non-earth tone.

16. The crossbow of claim 11 wherein the vibration dampener is attached to the arrow retention spring.

17. The crossbow of claim 11 wherein the vibration dampener is attached to the scope mount.

18. A method of dampening vibrations in a crossbow caused by an arrow retention spring, comprising the steps of:

providing a crossbow comprising: (a) a body having an arrow receiving area; (b) a bow operatively connected to the body and having a pair of bow arms; (c) a bowstring operatively connected to the bow arms; (d) a bowstring release mechanism operatively connected to the body for selectively holding and releasing the bowstring; and, (e) an arrow retention spring for retaining an arrow to the arrow receiving area; and, placing a vibration dampener into operative contact with the arrow retention spring to dampen vibrations caused by the arrow retention spring.

19. The method of claim 18 wherein the step of, placing a vibration dampener into operative contact with the arrow retention spring to dampen vibrations caused by the arrow retention spring, comprises the step of:

adhering the vibration dampener to the arrow retention spring.

20. The method of claim 18 further comprising the steps of:

providing the crossbow with a crossbow member; and, wherein the step of, placing a vibration dampener into operative contact with the arrow retention spring to dampen vibrations caused by the arrow retention spring, comprises the step of, inserting the vibration dampener between the arrow retention spring and the crossbow member.

21. The method of claim 20 wherein the step of, placing a vibration dampener into operative contact with the arrow retention spring to dampen vibrations caused by the arrow retention spring, comprises the step of:

adhering the vibration dampener to the crossbow member.

22. The method of claim 20 wherein the crossbow member has a channel, the step of, inserting the vibration dampener between the arrow retention spring and the crossbow member, comprises the step of:

sliding the vibration dampener at least partially within the channel in the crossbow member.

* * * * *